US012678707B2

(12) United States Patent
Gordon et al.

(10) Patent No.: US 12,678,707 B2
(45) Date of Patent: Jul. 14, 2026

(54) SYSTEMS AND METHODS FOR A DRY STEAM SPECIAL EFFECT

(71) Applicant: Universal City Studios LLC, Universal City, CA (US)

(72) Inventors: Michael Gordon, Glendale, CA (US); Matthew Robert Rossett, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 634 days.

(21) Appl. No.: 18/166,215

(22) Filed: Feb. 8, 2023

(65) Prior Publication Data

US 2024/0261699 A1 Aug. 8, 2024

(51) Int. Cl.
*A63G 31/00* (2006.01)
*A63J 5/02* (2006.01)

(52) U.S. Cl.
CPC ..... *A63J 5/025* (2013.01); *A63G 31/00* (2013.01)

(58) Field of Classification Search
CPC ..... A63J 2005/006; A63J 2005/005; A63J 2005/001–026; A63J 5/00–12; A63J 5/025; F24F 8/10; A63G 31/00
USPC ..... 137/1, 6, 201, 343–382, 5
See application file for complete search history.

(56) References Cited

U.S. PATENT DOCUMENTS

| | | | | |
|---|---|---|---|---|
| 3,469,837 | A * | 9/1969 | Heilig | A63J 25/00 472/60 |
| 3,628,829 | A * | 12/1971 | Heilig | G09B 9/165 297/217.3 |
| 4,223,722 | A * | 9/1980 | Shade, Jr. | F28F 9/0278 165/145 |
| 5,989,128 | A | 11/1999 | Baker et al. | |
| 8,917,980 | B2 | 12/2014 | Scully | |
| 9,095,782 | B2 | 8/2015 | Kaplan | |
| 10,240,278 | B2 * | 3/2019 | Chua | D06F 75/12 |
| 11,202,549 | B2 | 12/2021 | Krebs et al. | |
| 11,633,673 | B2 * | 4/2023 | Goergen | H05K 7/1428 463/31 |
| 2011/0062250 | A1 | 3/2011 | Betz et al. | |
| 2014/0083706 | A1 | 3/2014 | Scott et al. | |
| 2015/0105167 | A1 | 4/2015 | Kim et al. | |
| 2019/0072006 | A1 * | 3/2019 | Duffy | F01K 23/101 |
| 2019/0351340 | A1 | 11/2019 | Goergen et al. | |
| 2022/0054949 | A1 | 2/2022 | Raij et al. | |
| 2022/0371029 | A1 | 11/2022 | Erickson et al. | |

OTHER PUBLICATIONS

PCT/US2024/014500 International Search Report and Written Opinion mailed May 29, 2024.

* cited by examiner

*Primary Examiner* — Craig J Price
(74) *Attorney, Agent, or Firm* — Fletcher Yoder, P.C.

(57) ABSTRACT

A special effect system may include a steam generator, a reheater, and a steam separator configured to generate dry steam. The steam generator is coupled to a show element comprising a one or more compartments. Steam from the steam generator passes through the reheater and the steam separator before entering the one or more compartments such that condensate is removed and cooling of the steam within the system between the steam generator and the show element is remedied.

17 Claims, 4 Drawing Sheets

SYSTEMS AND METHODS FOR A DRY STEAM SPECIAL EFFECT

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Throughout amusement parks and other entertainment venues, special effects can be used to help immerse guests in the experience of a ride or attraction. Immersive environments may include three-dimensional (3D) props and set pieces, robotic or mechanical elements, electrical or chemical elements, and/or display surfaces that present media. For example, an immersive environment may be provided via show components that operate to produce a visual effects that are dispersed into the environment. However, generating dispersed special effects can be cumbersome and involve specialized equipment and materials and associated maintenance.

SUMMARY

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a dry steam special effect system may include a show element and a support structure coupled to the show element, wherein the support structure is coupled to the show element via an actuatable mechanism such that actuation of the actuatable mechanism relative to the support structure causes actuation of the show element. The dry steam special effect system may also include a steam generator coupled to the support structure and configured to generate steam. The dry steam special effect system may further include a reheater coupled to and in-line with the steam conduit and configured to reheat the steam received from the stem generator. Further, the dry steam special effect system may also include a steam separator coupled to and in-line with the steam conduit and configured to receive reheated steam from the reheater, wherein the steam separator is configured to separate condensate from the steam to generate dry steam, and wherein the show element is coupled to the steam conduit such that the dry steam is transferred to a compartment of the show element via the steam conduit.

In an embodiment, a dry steam special effect method for generating dry steam may include instructing a steam generator to generate steam in response to an activation signal, transferring the steam via a conduit to a reheater and a steam separator, instructing the reheater and the steam separator to heat the steam and separate condensate from the steam to generate dry steam, allowing the dry steam to fill one or more compartments of a show element, activating movement of the show element via an actuatable mechanism, and allowing the dry steam to exit via one or more outlets of the show element.

In an embodiment, an attraction system may include a show element comprising a compartment configured to release dry steam, a vehicle configured to move along a path proximate to the show element, and a controller communicatively coupled to the show element and the vehicle. The controller may determine a location of the vehicle and instruct one or more compressed air supplies and/or one or more blower to apply a positive pressure to release dry steam from the compartment based on the location of the vehicle.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
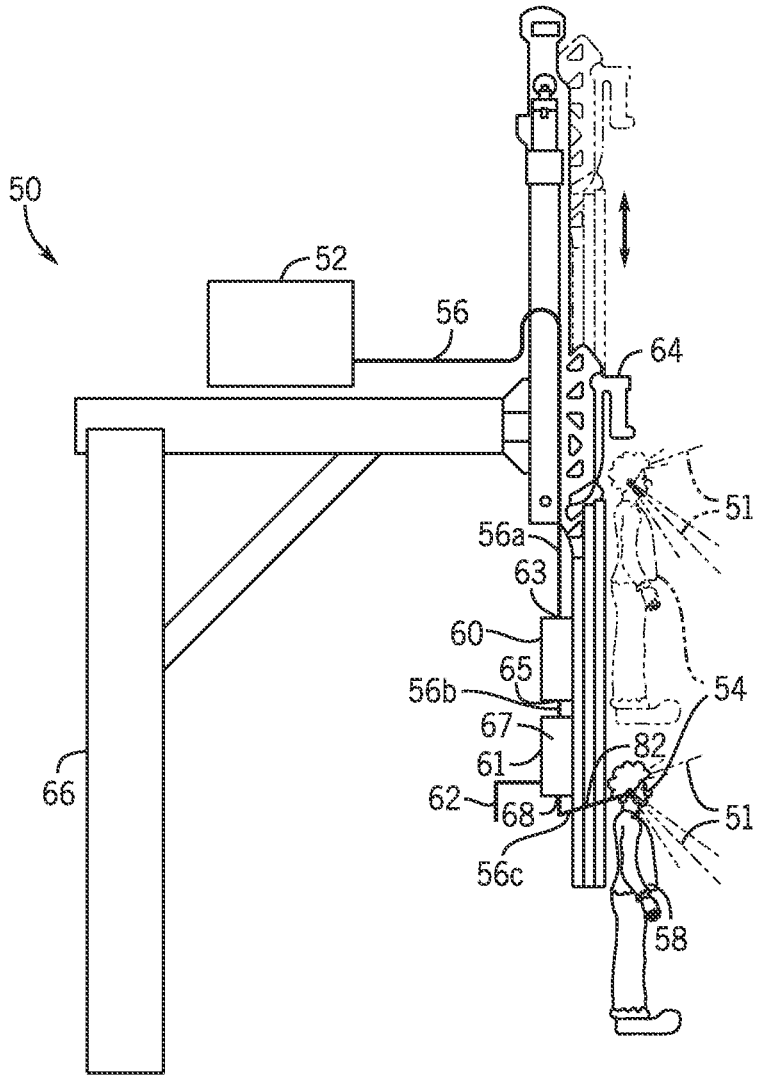
FIG. 1 is a schematic illustration of an embodiment of a dry steam special effect system, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to providing dry steam special effects for an amusement park or theme park. The amusement park may include a variety of attraction environments, such as rides (e.g., a roller coaster), theatrical shows, set designs, performers, and/or decoration elements, to entertain guests. Special effects may be used to supplement or complement the features, such as to provide the guests with a more immersive and/or unique experience. For example, the special effects may be presented to emulate real world elements in order to present a more realistic or immersive atmosphere for the guests. An attraction environment can include show elements, such as props, animated characters, background elements, set or theater elements, ride vehicle accessories or elements, queue features, etc. In certain embodiments, a show element may be configured as show action equipment that includes one or more moving parts that actuate to enhance narrative elements of the attraction or that operates as a stand-alone prop. Show elements may include special effects systems, such as audio, video, optical, haptic, and/or dispersive special effects.

Provided herein are dry steam special effects for show elements. In an embodiment, the show element may feature a dispersive dry steam special effect in which dry steam is emitted from the show element into the attraction environment. Delivering dry steam with reduced steam condensate from a show element can be challenging. It may be desirable to keep the relatively higher temperature steam generating equipment separated from temperature-sensitive parts of a show element, such as a controller (e.g., control circuitry) for moving parts, as well as separated from the general attraction environment. However, steam cools and condenses as it travels through fluid conduit or hosing. Thus, the greater the distance between a steam generator and the location of the emitted dry steam, the greater the potential loss of steam to condensate, which reduces the efficiency of the effect. As provided herein, these challenges may be mitigated using a steam generator to create steam for the show action equipment. In embodiments of the present disclosure, this steam may be transferred through a fluid conduit and/or a cable management service loop that can bend and flex as the show action equipment moves dynamically. The fluid conduit may connect to a reheater element to reheat any condensate that has been created as the steam cooled in transit. The reheated steam may then pass through a steam separator to further remove any condensate that may have been created and to ensure dry steam at the delivery point. Any residual condensate collected by the steam separator may be emptied to a drain or pumped back to be reused in the steam generator in closed loop system. The reheater and steam separator may be positioned proximate to the dry steam delivery point, e.g., proximate to a compartment into which the dry steam is transferred and that includes a dry steam outlet, such heat loss is reduced prior to dry steam delivery.

Thus, the steam generator can generate dry steam at a location that is separated from the guest-facing portion of the attraction. Although the steam generator can be configured for dry steam generation, partial cooling of the dry steam during transit results in water presence in the steam. Accordingly, reheating and steam separation at a point close to a dry steam delivery location restores an appropriate composition of dry steam for delivery.

With the preceding in mind, FIG. 1 is a schematic diagram of an embodiment of a special effect system 50 used to create a dry steam effect 51. For example, the special effect system 50 may include a steam generator 52 coupled to a show element 54. The steam generator 52 may be positioned on a support structure 66. A conduit 56 may couple the steam generator 52 to the show element 54. The conduit 56 may be configured to provide sufficient slack such that a coupled show action equipment actuatable mechanism 64 can move relative to the steam generator 52 while also carrying a portion of the conduit 56. That is, the conduit 56 is coupled to show action equipment actuatable mechanism 64 in a manner that permits the conduit to bend and/or flex to accommodate the movement while also remaining coupled to the steam generator 52. By separating the steam generator 52 from the show element 54, size and material constraints of components within the special effects system 50 may be reduced or eliminated. For example, the show element 54 may be any suitable shape, size, or material to operate as a repository for dry steam and a central point for releasing dry steam rather than a point for dry steam generation.

In an embodiment, the steam generator 52 operates, when active, to generate steam. The steam generator 52 may be a dry steam generator that generates dry steam. As discussed herein, even if the steam generator 52 generates dry steam, transfer through the conduit 56, including additional slack to permit movement of the show action equipment actuatable mechanism 64, towards the show element 54 may result in heat loss and condensate formation that is mitigated via reheating and separating as disclosed herein. The steam generator 52 may be coupled to one or more blowers (e.g., fans) and/or one or more compressed air supplies to create a positive pressure and push steam towards the show element 54. The motive force of the one or more blowers may depend on the arrangement of the show action equipment actuatable mechanism 64, the length and arrangement of the conduit 56, and the drop relative to the steam generator 52. In certain instances, the system 50 may be arrangement as a closed loop system with steam generated at the steam generator 52 being transferred through the conduit 56 and returning via a condensate conduit 59 (see FIG. 2).

The conduit 56 (and/or the condensate conduit 59) may be made of flexible steam hosing made of, for example, polymer (e.g., plastic (e.g., rubber)), metal, glass, carbon-reinforced material, glass-reinforced material, or other suitable material). In some embodiments, the conduit 56 may be heated and/or insulated so as to minimize the amount of condensate created as the dry steam travels through the conduit 56. As the dry steam travels through the conduit 56, the dry steam may be reheated by a reheater 60 along with any condensate that may have formed between the steam generator 52 and the reheater 60.

Figure 2:
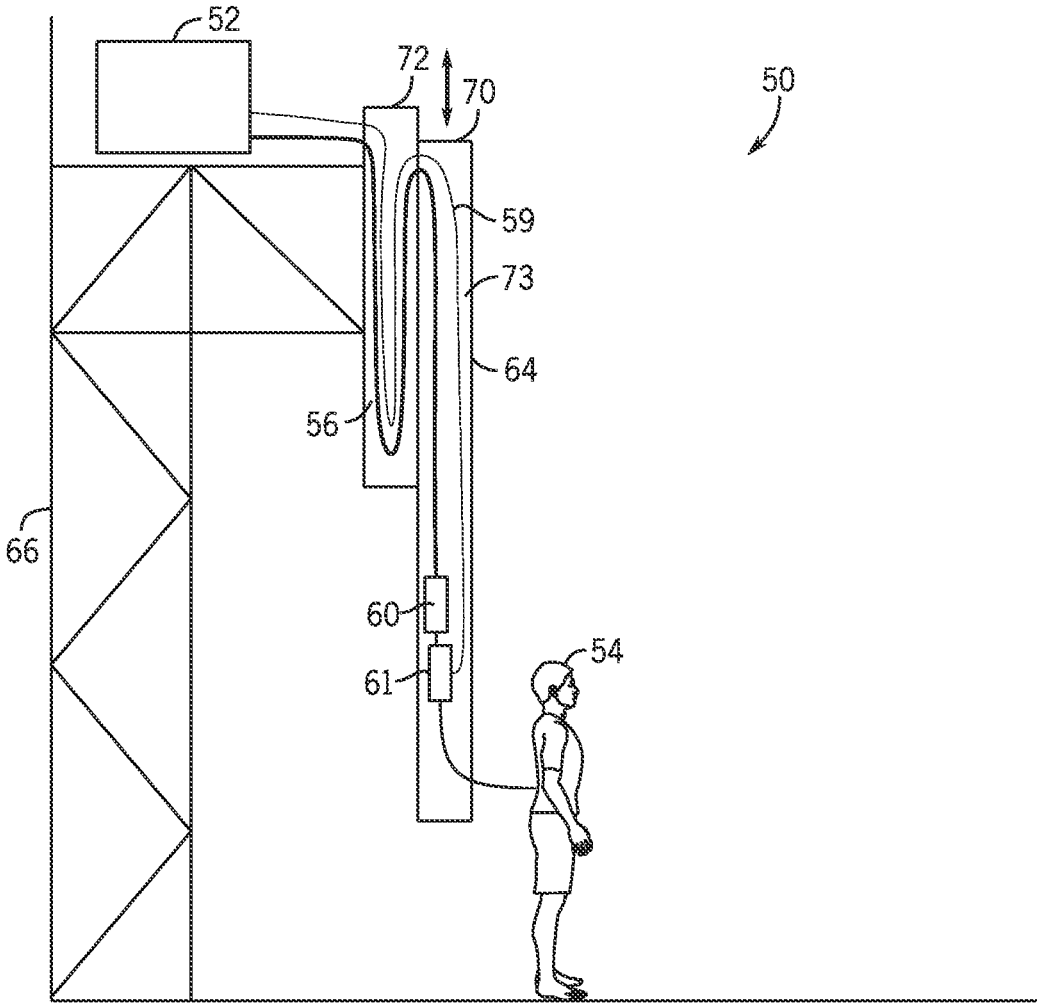
FIG. 2 is a schematic illustration of an embodiment of a dry steam special effect system, in accordance with an aspect of the present disclosure.

To adjust potential heat loss (i.e. condensate formation) between the steam generator 52 and the reheater 60, the length of the conduit 56 may vary, depending on the show action equipment being used, the amount of dry steam being generated, or other environmental factors affecting heat loss between the steam generator 52 and the reheater 60. As the dry steam continues to travel through the conduit 56 and after the steam has passed through the reheater 60, any remaining condensate may be separated via a steam separator 61. In some embodiments, the reheater 60 and the steam separator 61 may be coupled to the show action equipment actuatable mechanism 64 and, accordingly, move together with the show element 54 and relative to the steam generator 52. Further, although FIGS. 1 and 2 depict the reheater 60 and the steam separator 61 as separate components, in another embodiment, the reheater 60 and the steam separator 61 may be combined into a single component. Additionally or alternatively, there may be more than one reheater 60 and/or steam separator 61 depending on the amount of expected condensate. For example, if the show action equipment is operating in cold conditions or requires a longer conduit 56 between the steam generator 52 and the show element 54, then additional reheaters 60 and steam separators 61 may be desirable. In an embodiment, the reheater 60 and the steam separator 61 are positioned relatively closer to the show element 54 than the steam generator 52 such that the benefits of reheating and separation are achieved close to the location of the dry steam effect 51. The system may include a drain 62 to drain separated condensate. The drain 62 is illustrated as being adjacent to the steam separator 61.

The conduit 56 is in-line with the reheater 60 and the steam separator 61 to permit transfer of steam from the conduit 56 into and out of the reheater 60 and the steam separator 61. For example, the conduit 56 is fluidically coupled to the reheater 60 and the steam separator 61. In the illustrated example, a first portion 56*a* of the conduit 56 an be coupled to an inlet 63 of the reheater 60 to transfer the steam into a heated chamber of the reheater 60 to permit reheating. Heated steam then exits via an outlet 65 of the reheater 60 to a second portion 56*b* of the conduit 56 to be transferred via a separator inlet 67 into a separator interior to separate any condensate present after reheating. The separated dry steam exits the steam separator 61 via a separator outlet 68 that is coupled to a third portion 56*c* of the conduit 56. The third portion 56*c* of the conduit 56 couples directly or indirectly to the show element 54.

The show element 54 may include one or more compartments 58 for receiving and/or storing the dry steam of the dry steam effect 51. The one or more compartments 58 may be made from a non-breathable material, e.g., that is not porous to the dry steam, to hold the dry steam and may include the one or more outlets 82 for the dry steam to exit out of and create the dry steam effect 51. In the illustrated example, the one or more outlets 82 may include openings of different shapes and sizes. Further, the outlet openings may be covered by open weave material (e.g., scrim, mesh, perforated material) that includes multiple openings for dry steam to be released from the compartment 58. By controlling a number of the one or more outlets 82 within the one or more compartments 58, a shape and a size of the one or more outlets 82, the visual appearance of the dry steam effect 51 may be controlled (e.g., adjusted).

In an embodiment, the dry steam may be transferred through the conduit 56 to be subsequently released through one or more outlets 82. Alternatively, the dry steam may travel through the conduit 56 to be temporarily retained within the one or more compartments 58 of the show element 54 prior to triggering the dry steam effect. To trigger the dry steam effect, a positive pressure may be applied to the one or more compartments 58 to force the dry steam outwards through the one or more outlets 82 such that the dry steam effect is visible to provide a unique and/or realistic visualization of dry steam effects to guests within the amusement park.

For purposes of illustration, the show element 54 may be a humanoid figure, as depicted in FIG. 1. The one or more compartments 58 may form the body (e.g., torso) of the humanoid figure and the one or more outlets 82 may be positioned on the torso. However, it should be understood that other arrangements and configurations of the show element 54 are also contemplated (e.g., animals, vehicles, buildings, manhole cover steam effects).

FIG. 2 illustrates a closed loop arrangement of the system 50. In the illustrated arrangement, the reheated and separated dry steam may proceed to the one or more outlets 82 to create the special dry steam effect 51, while the extracted condensate may transfer through a condensate conduit 59 back to the steam generator 52, as shown in FIG. 2. The closed-loop arrangement retains heat within the system 50 while diverting the extracted condensate away from the mechanical components of the system 50 to avoid moisture buildup within the environment. Accordingly, depending on the distance between the steam generator 52 and the steam separator 61, the system 50 may include pumps or blowers to transfer the separated condensate via the condensate conduit 59. In an alternative arrangement, the condensate conduit may include a drain located away from the show element 54.

As discussed with respect to FIG. 1, the conduit 56 is coupled to the steam generator 52 and the show element 54 to permit movement of a portion of the conduit 56 together with the actuatable mechanism 64. Similarly, the condensate conduit 59 may also be coupled to the steam generator 52 and the show element 54 with sufficient slack to permit actuation within the full range of motion of the actuatable mechanism 64 and without strain on the conduit 56 and/or the condensate conduit 59. Portions of the conduit 56 and the condensate conduit 59 may run within a channel 73 formed within the actuatable mechanism 64. In embodiments, the channel 73 may be insulated to retain heat within the conduit 56.

The show element 54 may be coupled to the show action equipment actuatable mechanism 64, which is attached to the support structure 66. The show action equipment actuatable mechanism 64 may be configured to support and coordinate movement of the show element 54. For example, the show action equipment actuatable mechanism 64 may include a moveable portion 70 (e.g., robotic arm, moveable member) coupled to the show element 54 and configured to move the show element 54. Further, the show action equipment actuatable mechanism 64 may also include a static portion 72 that is fixed to the support structure 66 and allows for movement of the moveable portion 70. That is, the moveable portion 70 moves relative to the static portion 72. The show element 54 may be actuated by the show action equipment actuatable mechanism 64 via the movable portion 70. Thus, the conduit 56, including the conduit 56 and the condensate conduit 59, also move relative to the static portion 72 of the show action equipment actuatable mechanism 64. In this way, the show action equipment actuatable mechanism 64 may produce a visual effect perceivable to the guest, such as the show element 54 appearing to fly, float, levitate, fall, walk, or the like. In certain instances or at certain times, the show element 54 may be static and the show action equipment actuatable mechanism 64 may provide additional support to the show element 54. In another example, the show action equipment actuatable mechanism 64 may be supported by a transmission line (e.g., one or more cables) that may extend along (e.g., within, beside) the show action equipment actuatable mechanism 64 and supply power and/or data to the show element 54. As an example, power supplied via the transmission line may enable the show element 54 to be animated to portray a reaction or interact with other show elements of the attraction system. In this manner, operation and animation of the show element 54 may enhance the experience perceived by the guests.

Figure 3:
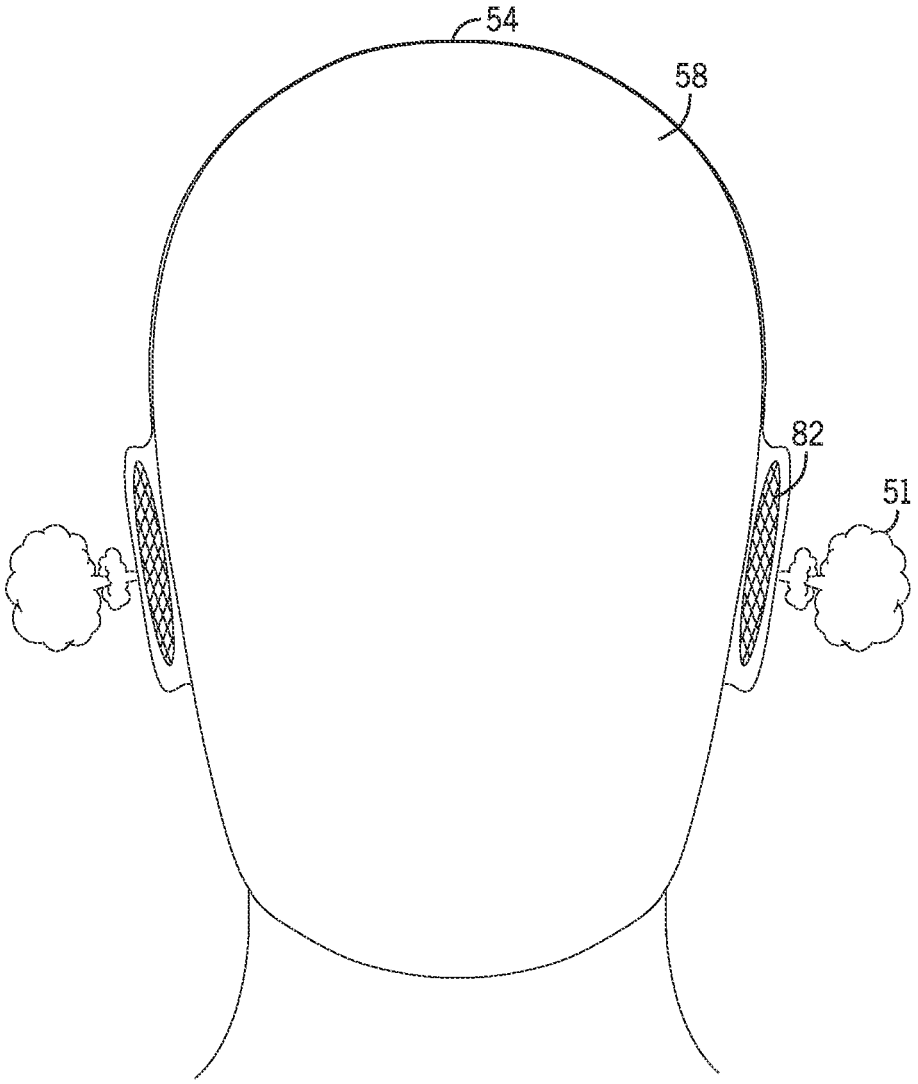
FIG. 3 is a schematic illustration of an embodiment of a dry steam effect generated by the dry steam special effect system, in accordance with an aspect of the present disclosure.

FIG. 3 shows an example of a dry steam effect emitted from the show element 54. In the illustrated example, the one or more compartments 58 may form the head of the humanoid figure and the one or more outlets 82 may be positions on or around the ears, as depicted in FIG. 3. To create the realistic and/or immersive environment, the show element 54 may also include one or more accessories.

Alternatively, the show element 54 may represent an animal, a fictional character, or an object. For example, accessories may include a hat and a cape worn by the show element 54. Furthermore, the appendages of the show element 54 and/or the accessories may be used to hide one or more elements (e.g., conduit 56, show action equipment actuatable mechanism 64, steam generator 52) of the special effect system 50 from guest view. While the illustrated embodiment depicts the show element 54 as a humanoid figure, in other embodiments, the show element 54 may represent an animal, a fictional character, or an object.

Figure 4:
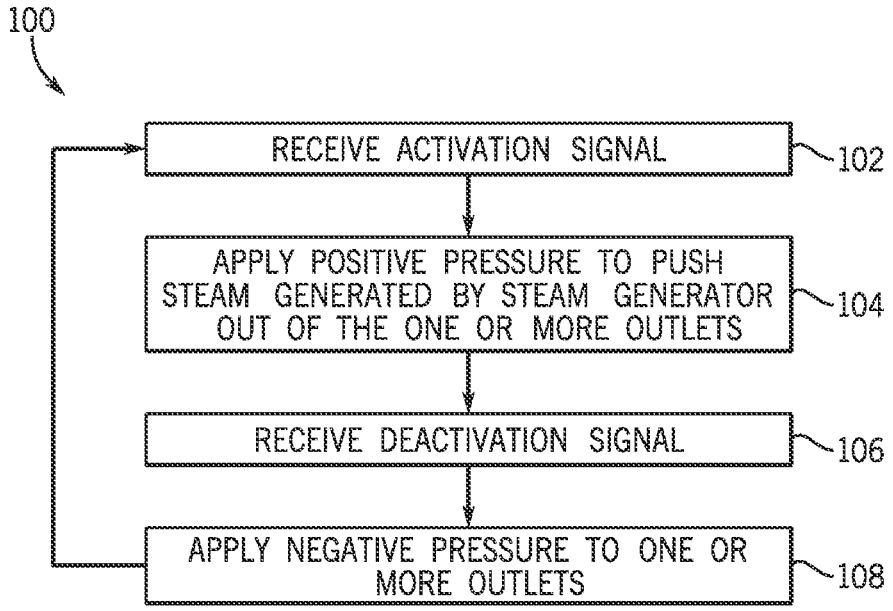
FIG. 4 is a flow diagram of an embodiment of a method for operating the dry steam special effect system, in accordance with an aspect of the present disclosure.

With the foregoing in mind, FIG. 4 is a flow diagram of an embodiment of an example method 100 for operating the special effect system 50. The method 100 is discussed with respect to features shown in FIGS. 1, 2, and 3. The method 100 may begin with an empty compartment state of the show element 54. The method 100 may be carried out according to instructions stored on one or more tangible, non-transitory, machine-readable media and/or may be instructed by a processor (e.g., processor of a controller (e.g., attraction controller 188, see FIG. 5) described herein or on another suitable controller. The blocks of the method 100 may be performed in any suitable order. Furthermore, certain blocks of the method 100 may be omitted and/or other blocks may be added to the method 100.

At block 102, the controller (e.g., control system) may receive an activation signal. For example, the controller may receive an indication (e.g., user input, automatic signal) to trigger the dry steam effect 51. In another example, the controller may receive a signal indicative of triggering the dry steam effect 51 based on received sensor signals or timing signals indicative of guest proximity to the system 50. In response to receiving the activation signal, the controller may instruct one or more vacuum blowers to pull dry steam from the steam generator 52 into the one or more compartments 58 (e.g., a body compartment as depicted in FIG. 1 or a head compartment as depicted in FIG. 3) via the conduit 56. As described herein, the steam generator 52 may be outside the show element 54 to reduce or eliminate complexity of the show element 54 and/or the one or more compartments 58. The steam generator 52 may be coupled to the one or more compartments 58 via a cable service management loop, which may include the conduit 56 and/or the condensate conduit 59, which may be formed from flexible ducting or hosing made of any suitable material, including a heated hose or other thermal hosing material. In one example, the steam generator 52 and/or the conduit 56 may include high pressure water lines to withstand heat or pressured used to create the dry steam effect 51.

A controller (e.g., control system) may instruct the steam generator 52 to continuously make steam, and initiation of the dry steam effect 51 may include opening valves located at or near the one or more outlets 82 or along the conduit 56 to permit the dry steam to exit to create the dry steam effect 51. In certain instances, the steam may travel through the conduit 56 to fill the one or more compartments 58 through diffusion or through a low level of positive pressure that is set to promote dry steam collection within the one or more compartments 58 but that is not sufficiently high enough to blow the dry steam out through the one or more outlets 82.

During an initial charging stage of the dry steam effect 51, it may be beneficial to create a low level of negative pressure, via one or more vacuum blowers, within the one or more compartments 58 to prevent dry steam from being released prior to triggering a visible stage of the dry steam effect 51. Thus, the charging stage of the dry steam effect 51 may include activation of a negative pressure at a level to keep any dry steam within the one or more compartments 58 from exiting through the one or more outlets 82.

At block 104, the controller may instruct one or more fluid current devices of the steam generator 52 to apply positive pressure to push the dry steam out of the one or more compartments 58. The steam generator 52 may include one or more air sources that may generate air to create a positive pressure to force the dry steam out of the compartments 58. As such, the dry steam effect 51 may be created. For example, the controller may instruct one or more compressed air supplies to create positive pressure to be applied to the one or more compartments 58. The positive pressure may push the dry steam out of the one or more outlets 82 of the one or more compartments 58, thereby creating the dry steam effect 51. In an embodiment, the positive pressure to push the dry steam through the one or more outlets 82 is higher than the pressure used to fill the one or more compartments 58.

At block 106, the controller may receive a deactivation signal. For example, the controller may receive an indication (e.g., user input, automatic signal) indicative of resetting the special effect system 50. The controller may instruct the steam generator 52 to enter an idle state in response to receiving the deactivation signal. In other instances, the controller may instruct the show action equipment actuatable mechanism 64 to return the show element 54 to a default position. At block 108, the controller may also instruct the one or more fluid current devices of the steam generator 52 to generate the negative pressure to remove dry steam from the one or more compartments 58.

In an embodiment, the controller may set, adjust, and/or change one or more parameters of the dry steam effect, in order to control the visual appearance of the dry steam effect 51, a timing of the dry steam effect 51, a length of the dry steam effect 51 or the like. For example, the controller may instruct the one or more valves located near the one or more outlets 82 to open or close, which may result in applying a positive pressure or a negative pressure to be applied to the one or more compartments 58. In another example, the controller may instruct the steam generator 52 or the show action equipment actuatable mechanism 64 to be in an active state or an idle state before, during, or after the dry steam effect 51. In an embodiment, the controller may instruct the steam generator 52 to remain in the active state to generate dry steam, the negative pressure, or the positive pressure. Further, the controller may instruct the show action equipment actuatable mechanism 64 to actuate the show element 54 to create a realistic and immersive environment for the guests. In this way, the controller may create visually realistic dry steam effect 51 and a realistic and/or immersive environment for the guests.

Figure 5:
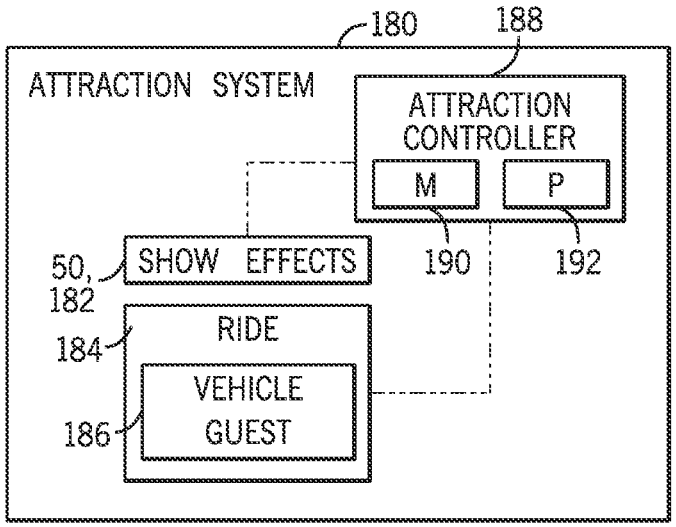
FIG. 5 is a block diagram of an embodiment of an attraction system including the dry steam special effect system, in accordance with an aspect of the present disclosure.

FIG. 5 is a block diagram of an embodiment of an attraction system 180 of an amusement park using the special effect system 50. For example, the attraction system 180 may include a roller coaster, a motion simulator, a water ride, a walk-through attraction (e.g., a maze), and the like. The attraction system 180 may also include special effects 182, which may be operated to enhance the guest experience provided by the attraction system 180. For instance, the special effects 182 may include light effects, a movable object (e.g., a robot), smoke effects, audio effects, and the like. The special effects 182 may also include the dry steam effect 51 created by the special effect system 50. For example, the dry steam effect 51 may be used in parallel with other special effects 182 to create a realistic and/or immersive environment for the guests.

The attraction system 50 may also include a ride 184, which may have a vehicle 186. The ride 184 may for example, include a roller coaster, a water ride, a motion simulator, a dark ride, and so forth. To this end, the vehicle 186 may move (e.g., translate, rotate, pivot) about a motion base and/or along a track of the attraction system 180 in an embodiment. In an additional or alternative embodiment, the vehicle 186 may remain stationary within the attraction system 180. One or more guests may be positioned within the vehicle 186. The ride 184 may entertain the guests via movement of the vehicle 186, such as by providing certain movement sensations for the guest. Additionally, or alternatively, the special effects 182 may entertain the guest(s) positioned in the vehicle 186, such as by providing realistic visual and/or audio effects.

In an embodiment, the special effect 182 may include combinations of electrical, visual, smell, smoke, audio, and dry steam effects. For example, the special effects 182 may include the dry steam effect 51 created by the special effect system 50 controlled by a controller (e.g., control system). The special effect system 50 may include the steam generator 52 configured to generate dry steam and to push the dry steam through the one or more fluid conduits of the conduit 56 coupled to the one or more compartments 58 to create the visual appearance of the dry steam effect 51. Further, the special effects 182 may include sounds effects, light effects, water effects, movement, visual effects, smelling effects, or the like that may be used in parallel with the dry steam effect. The special effects 182 may include certain displays with visual effects to compliment the dry steam effect. As described herein, the special effects 182 may also include certain smells or audio to compliment the dry steam effect.

The attraction system 180 may also include an attraction controller 188 (e.g., attraction control system) coupled to the steam generator 52 and the ride 184. The attraction controller 188 may include a memory 190 and processor 192 (e.g., processing circuitry). The memory 190 may include volatile memory, such as random-access memory (RAM), and/or non-volatile memory, such as read-only memory (ROM), optical drives, hard disc drives, solid-state drives, or any other non-transitory computer-readable medium that includes instructions to operate the attraction system 180. The processor 192 may be configured to execute such instructions. For example, the processor 192 may include one or more application specific integrated circuits (ASICs), one or more field programmable gate arrays (FPGAs), one or more general purpose processors, or any combination thereof.

Further, the attraction controller 188 may instruct additional special effects to be generated before, during, or after the dry steam effect 51. For instance, the attraction controller 188 may instruct movement of the vehicle 186 within the attraction system 180 and/or various outputs provided by steam generator 52. In an embodiment, the attraction controller 188 may set, adjust, and/or change one or more parameters of the dry steam effect, in order to control the appearance of the visual dry steam effect 51 provided. As an example, the attraction controller 188 may instruct the dry steam effect to result in the show element 54 appearing to move or travel in a certain manner relative to the vehicle 186. For instance, the attraction controller 188 may instruct the show element 54 to move towards the vehicle 186 and release dry steam during movement before reaching the vehicle 186. In another instance, the attraction controller 188 may instruct the show element 54 to move adjacent the vehicle 186. In an embodiment, the dry steam effect 51 is activated based on the location of the vehicle 186 being within a certain distance of the show element. For example, a vehicle location signal is provided to the system 50.

The special effect system 50 may be added to new and existing special effects. Furthermore, the special effect system 50 described herein may be installed in both new and existing show elements 54 (e.g., objects). Installation of the special effect system 50 includes incorporating the compartments within the figure or object and coupling to the steam generator equipment and/or the attraction controller 188. For example, the special effect system 50 may be applied to animated figures or other non-anthropomorphic shapes or objects with a cavity. Additionally or alternatively, the object may be coupled to the attraction controller 188 for the object to move relative to other special effects in the system.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A dry steam special effect system, comprising:

a show element;

a support structure coupled to the show element;

a steam generator configured to generate a steam and coupled to the support structure;

a steam conduit configured to receive the steam from the steam generator;

a reheater coupled to and in-line with the steam conduit and configured to reheat the steam received from the steam generator; and a steam separator coupled to and in-line with the steam conduit and configured to receive reheated steam from the reheater, wherein the steam separator is configured to separate condensate from the reheated steam to generate a dry steam, and wherein the show element is coupled to the steam conduit such that the dry steam is transferred to a compartment of the show element via the steam conduit.

2. The special effect system of claim 1, wherein:

the support structure is coupled to the show element via an actuatable mechanism such that actuation of the actuatable mechanism relative to the support structure causes actuation of the show element; and the compartment comprises one or more outlets configured to release the dry steam.

3. The special effect system of claim 2, wherein the outlets comprise a covering comprising a perforated material.

4. The special effect system of claim 2, wherein the reheater and the steam separator are coupled to and configured to move together with the actuatable mechanism.

5. The special effect system of claim 1, wherein the reheater and the steam separator are combined in a single unit.

6. The special effect system of claim 1, wherein the reheater is located upstream of the steam separator such that the reheater is positioned between the steam generator and the steam separator.

7. The special effect system of claim 1, comprising one or more positive pressure sources coupled to the steam generator.

8. The special effect system of claim 1, comprising or more pumps configured to transfer the condensate to a drain via a condensate conduit.

9. The special effect system of claim 8, wherein the drain is located adjacent to the steam separator.

10. The special effect system of claim 1, comprising a condensate conduit coupled to the steam generator and the steam separator.

11. The special effect system of claim 1, wherein the steam generator is configured to continuously generate steam.

12. A special effect method for creating a dry steam effect, the method comprising:

instructing, using an attraction controller, a steam generator to generate steam in response to an activation signal;

transferring the steam via a conduit to a reheater and a steam separator;

instructing the reheater and the steam separator to heat the steam and separate condensate from the steam to generate dry steam;

allowing the dry steam to fill one or more compartments of a show element; and allowing the dry steam to exit via one or more outlets of the show element while controlling movement of the show element using the attraction controller.

13. The method of claim 12, wherein the steam generator is positioned on a support structure.

14. The method of claim 13, comprising activating the movement of the show element via an actuatable mechanism, wherein the support structure comprises the actuatable mechanism.

15. The method of claim 12, comprising transferring separated condensate from the steam separator back to the steam generator via a condensate conduit.

16. The method of claim 12, comprising activating the movement of the show element via an actuatable mechanism, wherein the dry steam exits via the one or more outlets while the show element is moving.

17. The method of claim 12, comprising, instructing the steam generator to continuously generate steam in response to the activation signal.

* * * * *